US007775229B2

(12) United States Patent
Sy-Facunda

(10) Patent No.: US 7,775,229 B2
(45) Date of Patent: Aug. 17, 2010

(54) CANOPY WITH ONE OR MORE SIDE AWNINGS

(75) Inventor: Ron Sy-Facunda, Thousand Oaks, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 12/201,789

(22) Filed: Aug. 29, 2008

(65) Prior Publication Data

US 2010/0051078 A1 Mar. 4, 2010

(51) Int. Cl.
*E04H 15/58* (2006.01)
*E04H 15/50* (2006.01)

(52) U.S. Cl. ..... 135/117; 135/131; 135/145

(58) Field of Classification Search ..... 135/117, 135/143–145, 131, 94
See application file for complete search history.

(56) References Cited

U.S. PATENT DOCUMENTS

| | | | | |
|---|---|---|---|---|
| 39,416 | A | | 8/1863 | Moakley |
| 42,996 | A | | 5/1864 | Pullan |
| 590,706 | A | | 9/1897 | Lentz et al. |
| 785,872 | A | * | 3/1905 | Gleason ..... 5/113 |
| 1,531,622 | A | | 8/1921 | Parsons |
| 2,230,454 | A | | 12/1939 | Friesner et al. |
| 3,621,857 | A | | 11/1971 | May et al. |
| 4,077,419 | A | | 3/1978 | Lux |
| 4,179,053 | A | | 12/1979 | Figura |
| 4,200,115 | A | | 4/1980 | Parker |
| 4,201,412 | A | | 5/1980 | Williams et al. |
| 4,248,255 | A | | 2/1981 | Arrowsmith |
| 4,258,778 | A | | 3/1981 | Upton et al. |
| 4,285,354 | A | | 8/1981 | Beavers |
| 4,469,114 | A | | 9/1984 | Kelley et al. |
| 4,530,389 | A | | 7/1985 | Quinn et al. |
| 4,583,779 | A | | 4/1986 | Myers |
| 4,607,656 | A | | 8/1986 | Carter |
| 4,635,667 | A | | 1/1987 | Harn |
| 4,641,676 | A | | 2/1987 | Lynch |
| 4,720,945 | A | | 1/1988 | Berranger et al. |

(Continued)

FOREIGN PATENT DOCUMENTS

| | | |
|---|---|---|
| AU | 2002247358 | 5/2003 |

(Continued)

OTHER PUBLICATIONS

Final Rejection dated Jun. 3, 2009 received in Related U.S. Appl. No. 11/854,911.

(Continued)

*Primary Examiner*—David Dunn
*Assistant Examiner*—Danielle Jackson
(74) *Attorney, Agent, or Firm*—Holland & Hart LLP

(57) ABSTRACT

The technology of the present application provides a collapsible canopy shelter having one or more side awnings that are pivotally coupled to the canopy frame. The canopy shelter for this has reinforced eaves for additional structural integrity, as well as at least one collapsible ventilation flap in the canopy cover that is capable of moving between a closed position and an open position to ventilate air from beneath the canopy cover as desired. Further, the collapsible canopy shelter comprises a canopy frame with a robust, spring-loaded pull latch, allowing the user to quickly and easily assemble and, collapse the shelter without risking injury.

10 Claims, 13 Drawing Sheets

U.S. PATENT DOCUMENTS

| | | | | |
|---|---|---|---|---|
| 4,753,280 | A | | 6/1988 | Lohausen |
| 4,759,396 | A | | 7/1988 | Quinn |
| 4,779,635 | A | | 10/1988 | Lynch |
| 4,784,204 | A | | 11/1988 | Lohausen |
| 4,794,971 | A | | 1/1989 | Lohausen |
| 4,798,031 | A | | 1/1989 | George |
| 4,817,655 | A | | 4/1989 | Kaminski |
| 4,825,484 | A | | 5/1989 | Riegel |
| 4,865,066 | A | | 9/1989 | Brooks |
| 4,885,891 | A | * | 12/1989 | Lynch ..... 52/646 |
| 4,898,198 | A | | 2/1990 | Castlebury |
| 4,924,896 | A | | 5/1990 | Carter |
| 4,926,782 | A | | 5/1990 | Lacy |
| 4,930,183 | A | | 6/1990 | Owens |
| 4,947,884 | A | | 8/1990 | Lynch |
| 4,955,287 | A | | 9/1990 | Dupont |
| 4,976,487 | A | | 12/1990 | Ramos et al. |
| D316,288 | S | | 4/1991 | Lynch |
| 5,035,253 | A | | 7/1991 | Bortles |
| 5,090,435 | A | | 2/1992 | Leclercq |
| 5,092,262 | A | | 3/1992 | Lacy |
| 5,148,849 | A | | 9/1992 | Faludy |
| 5,174,352 | A | | 12/1992 | Murray et al. |
| 5,187,843 | A | | 2/1993 | Lynch |
| 5,224,307 | A | | 7/1993 | Lukos |
| 5,226,440 | A | | 7/1993 | Fuhrman |
| 5,234,011 | A | | 8/1993 | Lynch |
| 5,244,001 | A | | 9/1993 | Lynch |
| 5,299,395 | A | | 4/1994 | Smith et al. |
| 5,307,856 | A | | 5/1994 | Murray |
| 5,335,685 | A | | 8/1994 | Dahulich |
| 5,381,814 | A | | 1/1995 | Brandon |
| 5,407,007 | A | | 4/1995 | Lowrey |
| 5,421,356 | A | | 6/1995 | Lynch |
| 5,422,189 | A | | 6/1995 | Warner et al. |
| 5,472,007 | A | | 12/1995 | Malott |
| 5,485,863 | A | | 1/1996 | Carter |
| 5,490,533 | A | | 2/1996 | Carter |
| 5,511,572 | A | | 4/1996 | Carter |
| 5,591,530 | A | | 1/1997 | Warner et al. |
| 5,592,982 | A | | 1/1997 | Murray et al. |
| 5,601,104 | A | | 2/1997 | Perkins |
| 5,611,364 | A | | 3/1997 | Woods et al. |
| 5,632,292 | A | | 5/1997 | Carter |
| 5,632,293 | A | | 5/1997 | Carter |
| 5,678,361 | A | | 10/1997 | Bair |
| 5,700,048 | A | | 12/1997 | Wade et al. |
| 5,701,923 | A | | 12/1997 | Losi et al. |
| 5,797,412 | A | | 8/1998 | Carter |
| 5,806,547 | A | | 9/1998 | Derlinga |
| 5,813,425 | A | | 9/1998 | Carter |
| 5,836,330 | A | | 11/1998 | Franklin |
| 5,842,652 | A | | 12/1998 | Warsing et al. |
| 5,843,548 | A | | 12/1998 | Sanders |
| 5,909,761 | A | | 6/1999 | Murray |
| 5,918,614 | A | | 7/1999 | Lynch |
| 5,921,260 | A | | 7/1999 | Carter |
| 5,934,301 | A | | 8/1999 | Carter |
| 5,934,349 | A | | 8/1999 | Faller |
| 5,944,040 | A | | 8/1999 | Jang |
| 5,974,640 | A | | 11/1999 | Jang |
| 5,975,613 | A | | 11/1999 | Sippel |
| 5,995,385 | A | | 11/1999 | Shimamura |
| 6,006,810 | A | | 12/1999 | Malott |
| 6,021,796 | A | | 2/2000 | Vavra |
| 6,021,834 | A | | 2/2000 | Malott |
| 6,021,835 | A | | 2/2000 | Malott |
| 6,027,137 | A | | 2/2000 | Rura |
| 6,029,732 | A | | 2/2000 | Malott |
| 6,041,800 | A | | 3/2000 | Carter |
| 6,044,593 | A | | 4/2000 | Puls |
| 6,070,604 | A | | 6/2000 | Carter |
| 6,076,312 | A | | 6/2000 | Carter |
| 6,089,973 | A | | 7/2000 | Schultz |
| 6,095,221 | A | | 8/2000 | Frey, Jr. |
| 6,098,693 | A | | 8/2000 | Frey, Jr. |
| 6,112,392 | A | | 9/2000 | Becker et al. |
| 6,126,715 | A | | 10/2000 | Luk |
| 6,129,102 | A | | 10/2000 | Carter |
| 6,138,702 | A | | 10/2000 | Carter |
| 6,142,438 | A | | 11/2000 | Cooper et al. |
| 6,152,157 | A | | 11/2000 | Jang |
| 6,173,725 | B1 | | 1/2001 | Garth |
| 6,179,513 | B1 | | 1/2001 | Marasco |
| 6,192,910 | B1 | | 2/2001 | Carter |
| 6,206,020 | B1 | | 3/2001 | Lynch |
| 6,219,988 | B1 | | 4/2001 | Lynch |
| 6,227,217 | B1 | | 5/2001 | Peta |
| 6,230,729 | B1 | | 5/2001 | Carter |
| 6,230,783 | B1 | | 5/2001 | Frey, Jr. |
| 6,240,940 | B1 | | 6/2001 | Carter |
| 6,260,908 | B1 | | 7/2001 | Fraula et al. |
| 6,273,172 | B1 | | 8/2001 | Frey |
| 6,276,382 | B1 | | 8/2001 | Bindschatel et al. |
| 6,276,424 | B1 | | 8/2001 | Frey, Jr. |
| 6,279,641 | B1 | | 8/2001 | Malott |
| 6,283,136 | B1 | | 9/2001 | Chen |
| 6,283,537 | B1 | | 9/2001 | DeVore, III |
| 6,361,011 | B1 | | 3/2002 | Brutsaert |
| 6,361,057 | B1 | | 3/2002 | Carter |
| 6,363,956 | B2 | | 4/2002 | Carter |
| 6,374,842 | B1 | | 4/2002 | Carter |
| 6,382,224 | B1 | | 5/2002 | Carter |
| 6,394,868 | B1 | | 5/2002 | Katz |
| 6,397,872 | B1 | | 6/2002 | Carter |
| 6,412,507 | B1 | | 7/2002 | Carter |
| 6,418,953 | B1 | | 7/2002 | Novotny |
| 6,431,193 | B2 | | 8/2002 | Carter |
| 6,439,251 | B2 | | 8/2002 | Carter |
| 6,470,902 | B1 | | 10/2002 | Carter |
| 6,478,039 | B2 | | 11/2002 | Suh |
| 6,488,069 | B1 | | 12/2002 | Mashaw et al. |
| 6,502,597 | B2 | | 1/2003 | Carter |
| 6,508,262 | B1 | | 1/2003 | Takayama |
| 6,575,656 | B2 | | 1/2003 | Suh |
| 6,520,196 | B2 | | 2/2003 | Carter |
| 6,578,854 | B2 | | 6/2003 | Wucherpfenning et al. |
| 6,598,612 | B1 | | 6/2003 | Crowe |
| 6,601,599 | B2 | | 8/2003 | Carter |
| 6,622,425 | B2 | | 9/2003 | Shepherd |
| 6,662,816 | B1 | | 12/2003 | Cunningham |
| 6,666,223 | B2 | | 12/2003 | Price et al. |
| 6,692,058 | B1 | | 2/2004 | Micco |
| 6,701,949 | B2 | | 3/2004 | Carter |
| 6,705,664 | B1 | | 3/2004 | Lahutsky |
| 6,712,083 | B2 | | 3/2004 | Carter |
| 6,718,995 | B2 | | 4/2004 | Dotterweich |
| 6,725,807 | B1 | | 4/2004 | Tapia |
| 6,748,963 | B2 | | 6/2004 | Carter |
| 6,749,474 | B2 | | 6/2004 | Hsu et al. |
| 6,761,391 | B2 | | 7/2004 | Winkler |
| 6,772,780 | B2 | | 8/2004 | Price |
| 6,796,320 | B2 | | 9/2004 | Carter |
| 6,845,780 | B2 | | 1/2005 | Bishirjian |
| 6,868,858 | B2 | | 3/2005 | Suh |
| 6,874,520 | B2 | | 4/2005 | Carter |
| 6,920,889 | B2 | | 7/2005 | Carter |
| 6,926,021 | B2 | | 8/2005 | Carter |
| 6,981,510 | B2 | | 1/2006 | Carter |
| 7,007,706 | B2 | | 3/2006 | Pinnell et al. |
| 7,025,073 | B2 | | 4/2006 | Holub |
| 7,025,075 | B2 | | 4/2006 | Suh |
| 7,036,270 | B1 | | 5/2006 | Shepherd |
| 7,051,745 | B2 | | 5/2006 | Carter |

| | | | | |
|---|---|---|---|---|
| 7,055,538 | B2 | 6/2006 | Deng | |
| 7,074,124 | B2 | 7/2006 | Williams | |
| 7,097,380 | B2 | 8/2006 | Lee | |
| 7,134,443 | B1 | 11/2006 | Shires | |
| 7,146,996 | B1 | 12/2006 | Shires | |
| 7,178,541 | B2 | 2/2007 | Carter | |
| 7,178,542 | B2 | 2/2007 | Carter | |
| 7,207,344 | B2 | 4/2007 | Wu | |
| 7,210,492 | B2 | 5/2007 | Gerrie et al. | |
| 7,234,753 | B2 | 6/2007 | Held et al. | |
| 7,240,685 | B2 | 7/2007 | Seo | |
| 7,240,686 | B2 | 7/2007 | Seo | |
| 7,240,687 | B2 | 7/2007 | Carter | |
| 7,252,108 | B2 | 8/2007 | Carter | |
| 7,299,612 | B2 | 11/2007 | Carter | |
| 7,308,901 | B2 | 12/2007 | Mayer | |
| 7,311,112 | B2 | 12/2007 | Pacheco | |
| 7,328,935 | B1 | 2/2008 | Tarin | |
| 7,354,096 | B2 | 4/2008 | Hacker | |
| 7,360,549 | B2 | 4/2008 | Seo | |
| 7,380,563 | B2 | 6/2008 | Seo | |
| 7,395,830 | B2 | 7/2008 | Seo | |
| 7,406,977 | B1 | 8/2008 | Shires | |
| 7,409,963 | B2 * | 8/2008 | Mallookis et al. | 135/144 |
| 7,428,908 | B2 | 9/2008 | Seo | |
| RE40,544 | E | 10/2008 | Suh | |
| RE40,657 | E | 3/2009 | Suh | |
| 7,568,491 | B2 * | 8/2009 | Banfill et al. | 135/88.08 |
| 2002/0092555 | A1 | 7/2002 | Chen et al. | |
| 2006/0062632 | A1 | 3/2006 | Jang | |
| 2006/0096631 | A1 | 5/2006 | Mallookis et al. | |
| 2006/0130887 | A1 | 6/2006 | Mallookis et al. | |
| 2006/0169311 | A1 | 8/2006 | Hwang | |
| 2006/0260666 | A1 * | 11/2006 | Choi | 135/94 |
| 2007/0079855 | A1 | 4/2007 | Li | |
| 2007/0186967 | A1 * | 8/2007 | Zingerle | 135/145 |

FOREIGN PATENT DOCUMENTS

| | | |
|---|---|---|
| AU | 2004203308 | 2/2005 |
| CA | 2447952 | 11/2002 |
| CA | 2475232 | 2/2005 |
| CA | 2455021 | 4/2007 |
| CA | 2441567 | 6/2007 |
| EP | 534843 | 3/1993 |
| GB | 2398346 | 4/2005 |
| GB | 2392459 | 11/2005 |
| GB | 2404932 | 11/2005 |
| GB | 2406107 | 11/2005 |
| GB | 2410041 | 11/2005 |
| GB | 2410962 | 10/2008 |
| GB | 2472418 | 4/2009 |
| WO | WO 89/07696 | 8/1989 |
| WO | WO 02/68779 | 9/2002 |
| WO | WO 2004/059106 | 7/2004 |

OTHER PUBLICATIONS

Non-Final Office Action dated Dec. 18, 2008 received in Related U.S. Appl. No. 11/855,013.

Non-Final Office Action dated Nov. 20, 2008 received in Related U.S. Appl. No. 11/854,911.

Non-Final Office Action dated Sep. 28, 2009 received in Related U.S. Appl. No. 11/854,974.

Related U.S. Appl. No. 11/854,911, filed Sep. 13, 2007 Title Canopy Latch System.

Related U.S. Appl. No. 11/855,013, filed Sep. 13, 2007 Title Canopy With Ventilation.

Related U.S. Appl. No. 11/854,974, filed Sep. 13, 2007 Title Canopy With Reinforced Eaves.

* cited by examiner

CANOPY WITH ONE OR MORE SIDE AWNINGS

This application is related to U.S. application Ser. No. 11/855,013, filed Sep. 13, 2007 and U.S. application Ser. No. 11/854,974, filed Sep. 13, 2007, each of which are herein incorporated by reference.

FIELD

The present invention relates generally to collapsible canopy shelters and more specifically to collapsible canopy shelters with one or more adjustable side awnings.

BACKGROUND

Many tents and canopy shelters with collapsible frames exist. These structures are commonly used to provide portable shelter for outdoor activities such as camping, picnicking, parties, weddings, and more. Such collapsible canopy shelters typically comprise a canopy cover and a canopy frame configured to stand alone when in an assembled position and to collapse into a compact position for storage and transport.

While conventional collapsible canopy shelters, are useful for a variety of purposes, such as providing portable shade and/or shelter from the elements and providing an aesthetically pleasing backdrop for special events, conventional canopy frames lack structural integrity. As a result, they are vulnerable to severe weather and human or animal interference and are prone to bow or sag.

In addition, the support poles of conventional canopy frames typically have unreliable latches that stick when the user attempts to assemble or collapse the shelter. Moreover, traditional spring-pin latches, or latches comprising a retractable spring pin that the user pushes inward to release, are temperamental to use and can pinch the user's hands and fingers when he or she attempts to assemble or collapse the shelter.

Moreover, conventional canopy covers do hot allow for adjustable ventilation. They either have no ventilation at all and trap unwanted heat during warm weather, or alternately, they have permanent screens or vents that vent much needed warm air during cool weather. There is therefore a need in the art for a collapsible canopy shelter having a frame with greater structural rigidity and stability and robust, easy to use pull latches, as well as an adjustable ventilation system.

Additionally, conventional collapsible canopy shelters provide a limited amount of shade and shelter and offer little or no lateral protection from the environment. Individuals must be positioned directly under a conventional canopy to be sheltered from the sun or rain, which may often lead to overcrowding under the canopy in inclement weather. Conventional canopies are also incapable of protecting individuals from elements such as wind, which generally moves horizontally and will not be impeded by the cover over a canopy.

SUMMARY

Embodiments disclosed herein address the above stated needs by providing a collapsible canopy shelter with reinforced eaves to provide greater structural integrity. The technology of the present application also features a collapsible flap capable of moving between a closed and an open position to ventilate air from the collapsible canopy shelter when desired. Another aspect of the technology of the present application includes a sliding, spring-loaded pull latch to lock the eaves in an assembled position. Still another aspect of the technology of the present invention includes adjustable side awnings offering additional cover and protection from the elements.

The foregoing, as well as other features, utilities, and advantages of the invention will be apparent from the following more particular description of a preferred embodiment of the invention as illustrated in the accompanying drawings.

DETAILED DESCRIPTION

Figure 1:
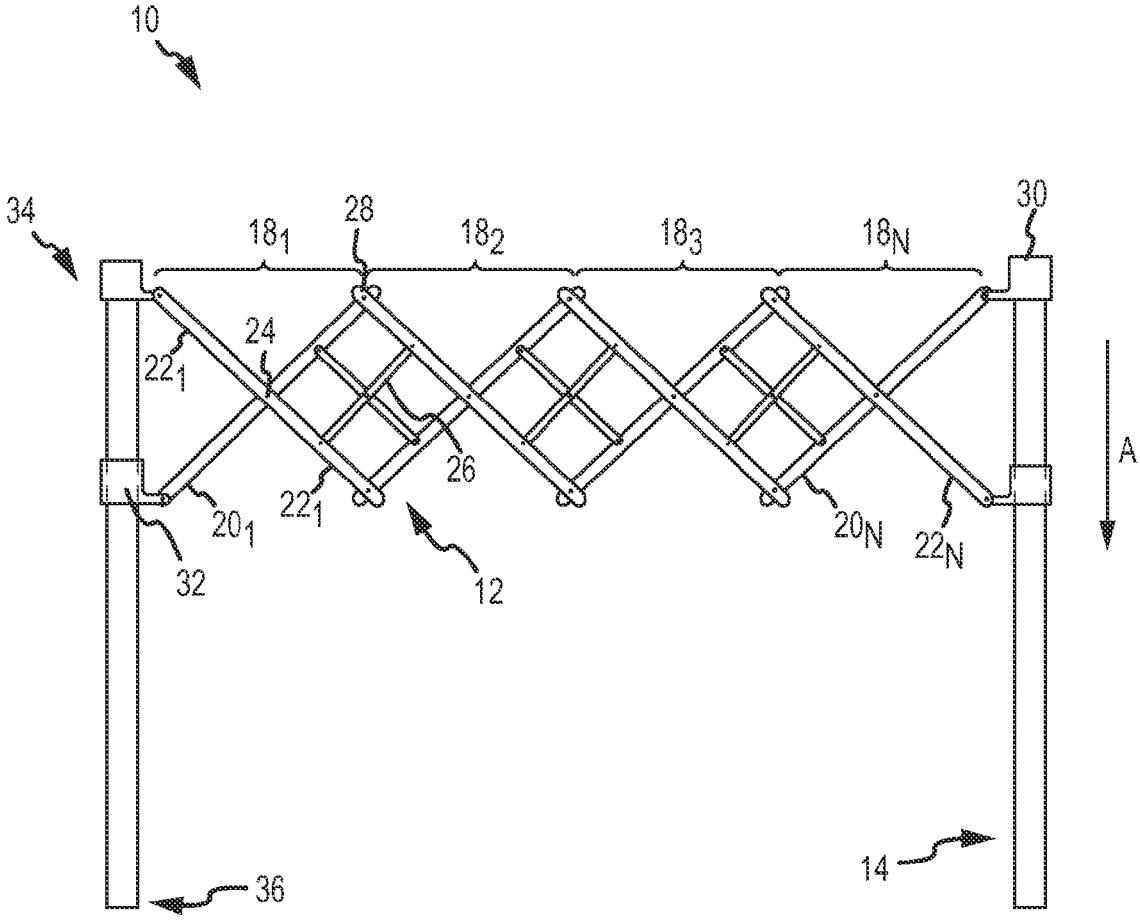
FIG. 1 shows a front plan view of one embodiment of a canopy frame for a collapsible canopy shelter.

The technology of the present application will be further explained with reference to FIGS. 1 through 13. FIG. 1 shows a front plan view of one embodiment of a canopy frame 10 for a collapsible canopy shelter. In this embodiment, canopy frame 10 comprises a plurality of eaves 12 linking a plurality of upwardly extending poles 14. Each eave 12 may comprise a series of pivotally coupled scissor-jacks $\mathbf{18}_{1\text{-}n}$. Each scissor-jack $\mathbf{1\text{-}8}_{1\text{-}n}$ may include a left cross member $\mathbf{20}_{1\text{-}n}$ and a right cross member $\mathbf{22}_{1\text{-}n}$, crossed and pivotally coupled at a cross point 24. To provide additional rigidity to improve the structural integrity of canopy frame 10, two reinforcing cross members 26 may be crossed and pivotally coupled to left cross members $\mathbf{20}_{1\text{-}n}$ and right cross members $\mathbf{22}_{1\text{-}n}$ at each intersection 28 of scissor-jacks $\mathbf{18}_{1\text{-}n}$. All pivoting joints may be pinned, bolted, riveted, joined by rotational fasteners, or otherwise rotatively connected as is known in the art.

Each eave 12 may be collapsibly coupled to a pair of upwardly extending poles 14 through two fixed eave mounts 30 and two sliding eave mounts 32. Fixed eave mounts 30 may be fixably coupled to the top ends 34 of upwardly extending poles 14, and sliding eave mounts 32 may be slidably coupled to poles 14, such that sliding eave mounts 32 slide over the length of upwardly extending poles 14 from the bases 36 of poles 14 to just below fixed eave mounts 30. In turn, a first left cross member $\mathbf{20}_1$ and a final right cross member $\mathbf{22}_N$ may be pivotally coupled to sliding eave mounts 32 while a first right cross member $\mathbf{22}_1$ and a final left cross member $\mathbf{20}_N$ may be fixably coupled to fixed eave mounts 30, allowing, scissor-jacks $\mathbf{18}_{1\text{-}N}$ to collapse in a manner similar to the compression of an accordion when one or more of sliding eave mounts 32 are released and slid in a downward direction denoted by arrow A.

Of course, one of ordinary skill in the art will readily understand that several alternative mechanisms could be used to collapsibly couple eaves 12 to upwardly extending poles 14. For example, eaves 12 could be coupled to upwardly extending poles 14 through locking channel systems or a quick release for scissor-jacks $\mathbf{18}_{1\text{-}N}$, as is generally known in the art.

Figure 2:
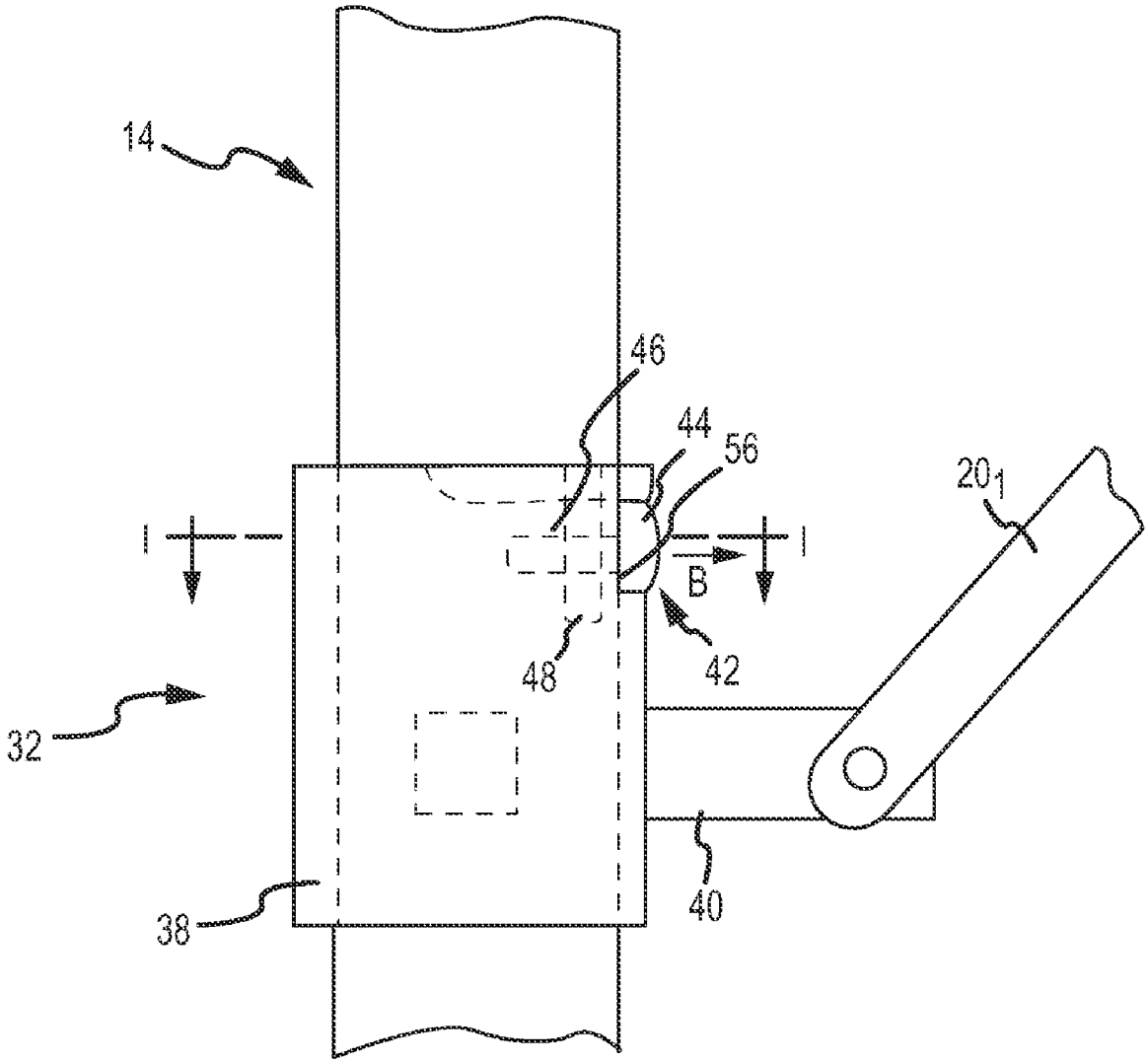
FIG. 2 shows a side plan view of one embodiment of a sliding eave mount slidably coupled to an upwardly extending pole and fixably coupled to the first left cross member.

FIG. 2 shows a side plan view of sliding eave mount 32 slidably coupled to upwardly extending pole 14 and fixably coupled to first left cross member $\mathbf{20}_1$. In this embodiment, sliding eave mount 32 may comprise a sliding body 38, a plurality of arms 40 to fixably attach to eaves 12 (e.g., via first left cross member $\mathbf{20}_1$ as illustrated in FIG. 2), and a latch 42. In further detail, latch 42 may comprise a spring-loaded lever 44 with a locking pin 46 that is pivotally coupled to sliding body 38 through a hinge pin 48 that may be press fit into sliding body 38. A torsion spring 50 (FIGS. 3, 4) may encircle hinge pin 48, such that a first leg 52 and a second leg 54 of torsion spring 50 compress when lever 44 is pulled in the direction of arrow B. Lever 44 and locking pin 46 may be configured to allow locking pin 46 to mate with a pin hole 56 located in upwardly extending pole 14 when latch 42 and locking pin 46 are slid into alignment with pin hole 56.

Figure 3:
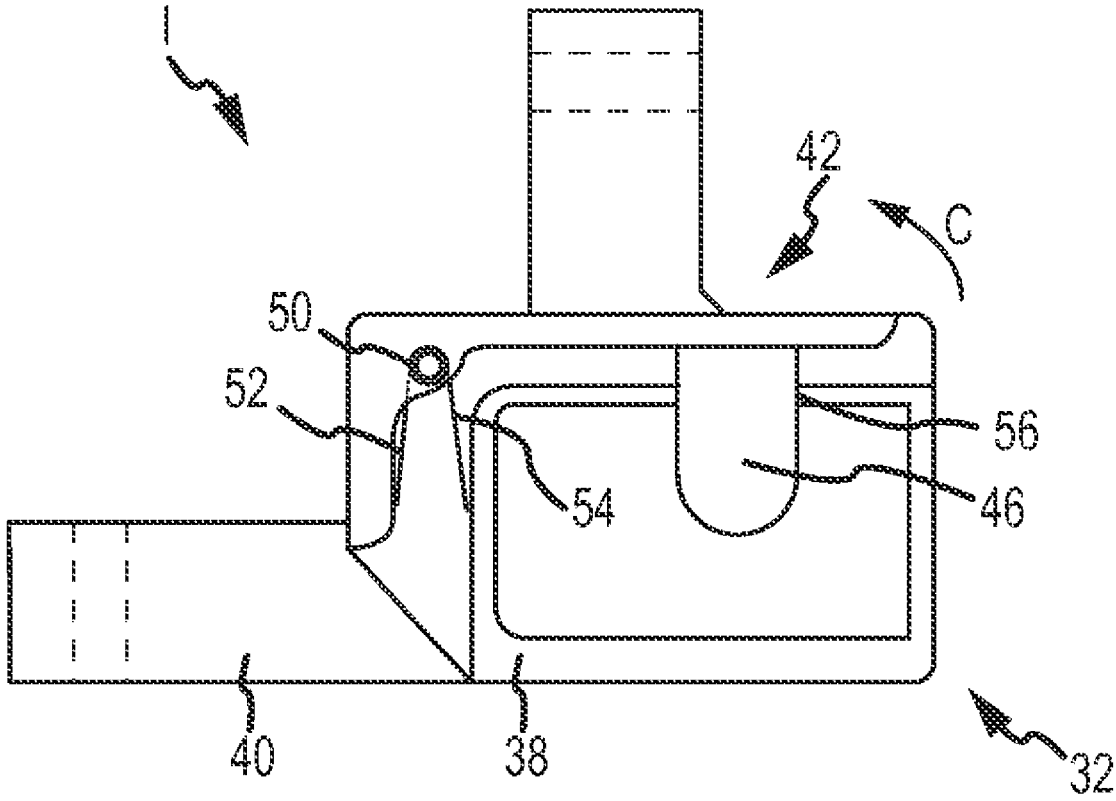
FIG. 3 shows a sectional view of one embodiment of the sliding eave mount shown in FIG. 2 with the latch in the locked position.
Figure 4:
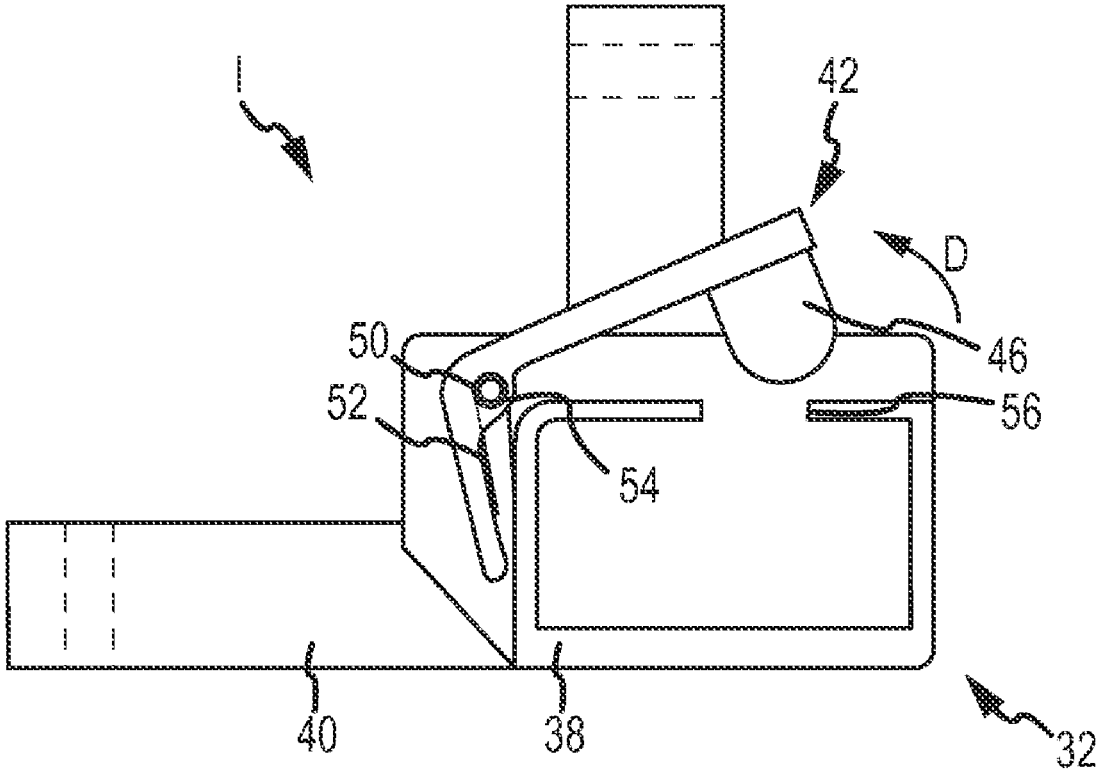
FIG. 4 shows a sectional view of the embodiment of the sliding eave mount shown in FIG. 2 with the latch in the unlocked position.

FIGS. 3 and 4 show sectional views of one embodiment of sliding eave mount 32 with latch 42 in the locked and unlocked positions, respectively. To unlock latch 42, a user may swivel latch 42 in the direction of arrows C and $C_1$, thereby withdrawing locking pin 46 from pin hole 56 and compressing torsion spring 50. Swiveling latch 42 in the directions of arrows C and $C_1$ may be accomplished by, for example, prying or pulling on latch 42 in the area of arrow C or pushing on latch 42 in the area of arrow C'. As a result, sliding eave mount 32 may slide in a downward direction along upwardly extending pole 14 (FIG. 1) and allow eave 12 to collapse as upwardly extending pole 14 is moved inward towards the remaining upwardly extending poles 14.

To lock latch 42, a user may slide sliding eave mount 32 upward into alignment with pin hole 56. Once in alignment, torsion spring 50 automatically pivots latch 42 in the direction of arrow D (FIG. 4), thereby snapping locking pin 46 into pin hole 56 and locking sliding eave mount 32 into an assembled position. While described as a torsion spring here, other elastically deformable devices are possible, including, for example, helical or coil springs, leaf springs, or the like. These deformable devices may be formed of spring metals such as music wire or metal alloys, plastics, composites, or any other suitable material known in the art.

Figure 11:
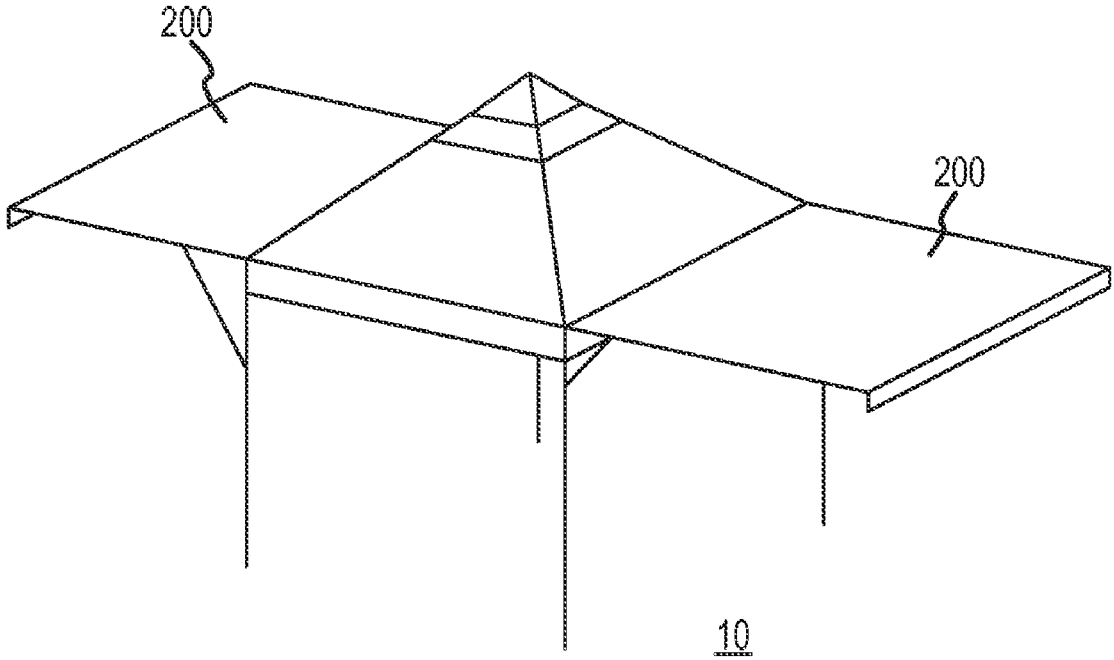
FIG. 11 shows a perspective view of one embodiment of an adjustable side awning for a collapsible canopy shelter.

As shown in FIG. 11, the canopy frame 10 may also include one or more side awnings 200. While FIG. 11 shows a canopy frame 10 having two side awnings 200, the canopy frame 10 may have fewer or greater than two side awnings 200.

Figure 12:
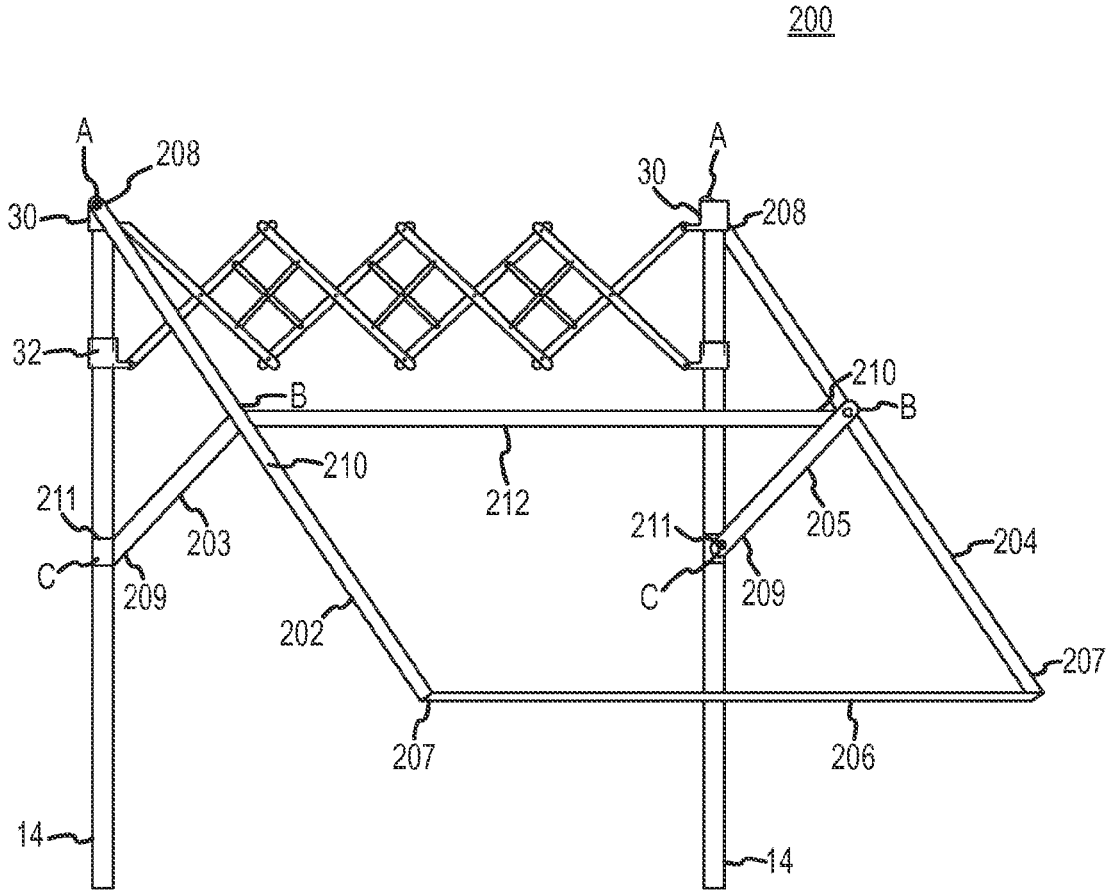
FIG. 12 shows a partial perspective view of one side of the embodiment shown in FIG. 11 with the awning cover removed.

As shown in FIG. 12, each side awning 200 comprises a first awning arm 202, a first awning arm support 203, a second awning arm 204, a second awning arm support 205, one or more awning arm connecting portion 206. The side awning may also optionally include an intermediate support 212.

Figure 13:
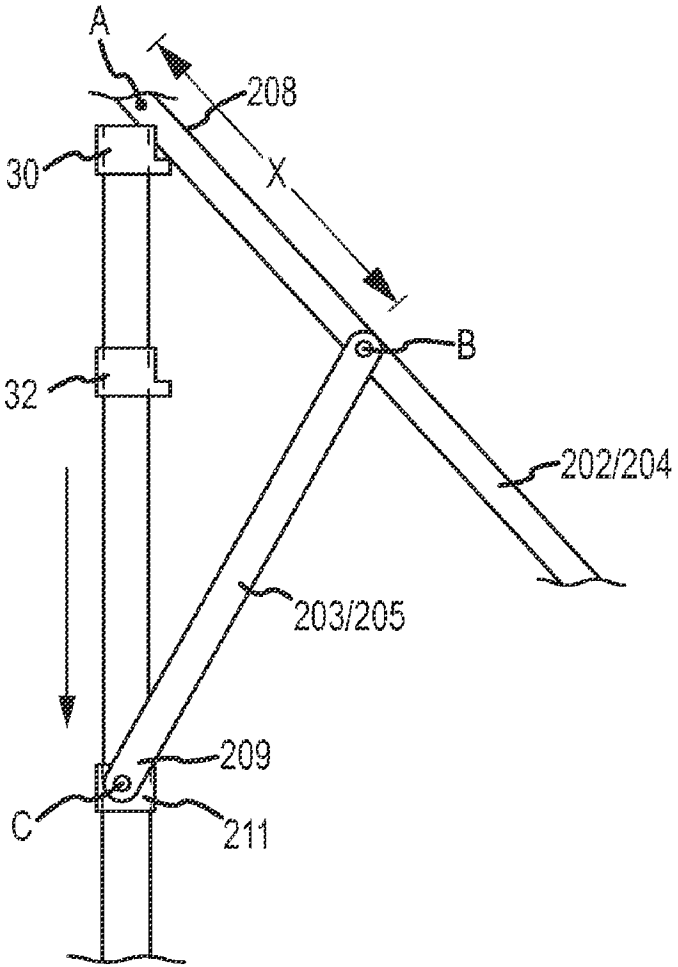
FIG. 13 shows partial side plan views of the embodiment of the side awning in different positions.
Figure 13:
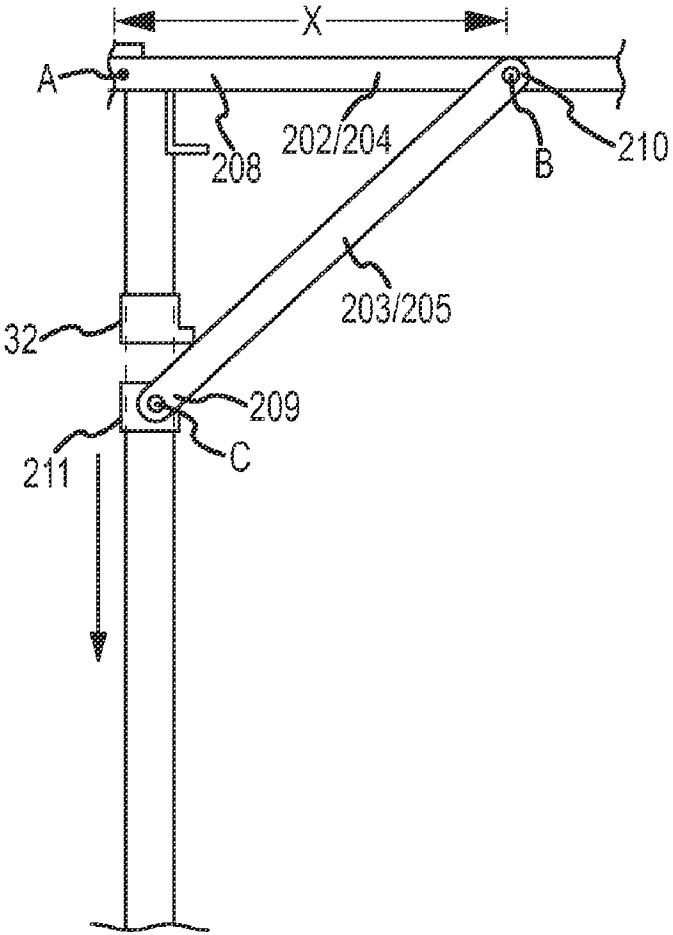

As shown in FIGS. 12 and 13, the first and second awning arms 202, 204 each have a first end 208 and second end 207 and are approximately equal in size and shape. In one embodiment, the length of the first and second awning arms 202, 204 is approximately equal to the height of the upwardly extending poles 14 of the canopy frame 10. In such a configuration, the first and second awning arms 202, 204 may be retractable and extendible. In other words, at full extension, the first and second awning arms 202, 204 are approximately equal to the height of the upwardly extending poles 14, while when retracted, the first and second arms 202, 204 may be any length shorter than the height of the upwardly extending poles 14. For example, the extendible and retractable awning arms may be retracted to a length approximately half the height of upwardly extending poles 14 to thereby form a "half" awning. Extension and retraction of the first and second awning arms may be achieved by, for example, telescoping, unfolding, or by adding additional lengths of awning arms.

First and second awning arms 202, 204 need not be extendible and retractable. In one configuration, the first and second awning arms 202, 204 have a length approximately half the height of the upwardly extending poles 14 to thereby form a "half" awning, and do not include extendable sections of awning arm. Other side awning lengths, for example, "three-quarters" awnings, "one-quarter" awnings, etc., are also possible The first end 208 of the first awning arm 202 is coupled to an upwardly extending pole 14 of the canopy frame 10. The first end 208 of the second awning arm 204 is coupled to an upwardly extending pole 14 of the canopy frame 10 adjacent the upward extending pole to which the first awning arm 202 is coupled. The first ends 208 of the first and second awning arms 202, 204 may be coupled to the upwardly extending pole 14 at a location approximate to the fixed eave mount 30. The first and second awning arms 202, 204 are coupled to the upwardly extending poles 14 in a manner that allows the first and second awning arms 202, 204 to pivot about a pivot point A. The first and second awning arms 202, 204 pivot in planes parallel to each other.

As shown in FIG. 12, the awning arm connecting portion 206 may couple to the second end 207 of the first awning arm 202 and the second end 207 of the second awning arm 204 at right angles, and may have a length equal to the distance between adjacent upwardly extending poles 14 when the canopy frame 10 is fully opened. In such a configuration, an awning cover frame in the general shape of a rectangle is formed. In an alternate embodiment, the awning arm connecting portion 206 may be longer or shorter than the distance between adjacent upwardly extending poles 14 and may couple to second ends 207 at angles greater than or less than 90 degrees, to thereby form trapezoidal shaped awnings.

In one embodiment, the awning arm connecting portion 206 is detachably coupled to the first awning arm 202 and second awning arm 204 in order to facilitate collapsing the canopy frame 10. Any suitable mechanism for detachably coupling the awning arm connecting portion 206 to the first and second awning arms 202, 204 may be used. Alternatively, awning arm connecting portion 206 may comprise telescoping portions or foldable portions to facilitate collapsing the canopy and awning into a compact shape for storage and transport or opening the canopy and awning into an expanded state for use.

The awning cover frame may include an intermediate support 212 that further supports the awning cover frame. The intermediate support 212 may be coupled at each end to a first or second awning arm 202, 204. The intermediate support 212 may also be aligned in parallel with the awning arm connecting portion 206. The intermediate support 212 may be located anywhere along the length of the first and second awning arms 202, 204. For example, the intermediate support 212 may be located approximately half way down the length of the first and second awning arms 202, 204. As with the awning arm connecting portion 206, the intermediate support 212 may comprise telescoping portion or foldable portions to facilitate collapsing of the canopy and awning.

The awning cover frame supports an awning cover. The awning cover is draped over the awning cover frame and preferably pulled taught so that the cover does not sag in the central, unsupported portion of the frame. Additionally, the intermediate support 212 may serve to prevent the awning cover from sagging. The awning cover may be coupled to the awning frame by any suitable means, such as by buttons, straps, zippers and the like. The awning cover may have an area approximately equal to the area of the cover frame, although the awning cover may also be slightly larger so as to drape over the sides of the awning frame, thereby providing additional shade.

As shown in FIGS. 12 and 13, the first awning arm support 203 and second awning arm support 205 each have a first end 209 and a second end 210. The second end 210 of the first awning arm support 203 is coupled to the first awning arm 202 at a distance x away from the first end 208 of the first awning arm 202. Similarly, the second end 210 of the second awning arm support 205 is coupled to the second awning arm 204 at the same distance x away from the first end 208 of the second awning arm 204. The second end 210 of the first awning arm support 203 and the second end 210 of the second awning support arm 205 are coupled to the first awning arm 202 and second awning arm 205, respectively, in a manner that allows the first awning arm support 203 and second awning arm support 205 to pivot about a pivot point B.

As shown in FIG. 13, the first end 209 of the first awning arm support 203 and the first end 209 of second awning arm support 205 are each coupled to a sliding support mount 211 that in turn is slidably coupled to upwardly extending pole 14. The first end 209 of the first awning arm support 203 and the first end 209 of the second awning arm support 205 are coupled to the upwardly extending poles 14 in a manner that allows the first awning arm support 203 and second awning arm support 205 to pivot about a pivot point C. The sliding support mount 211 may include a latch as described above with respect to the sliding eave mount 32 or any other suitable mechanism for allowing the sliding support mount 211 to slide up and down the upwardly extending pole 14 and lock into place to position the side awning 200 at a desired angle or position. The sliding support mount 211 is located below the sliding eave mount 32 so that the sliding support mount 211 may freely slide up and down to reposition the side awning without being blocked by the sliding eave mount 32. This allows selectable deployment of the side awning. However, it would be possible to couple the first and second awning arm supports 203, 205 to sliding eave mount 32. But this may cause deployment of the side awning 200 whenever the canopy is in use.

In one embodiment, the sliding support mount 211 includes a hole and the upwardly extending poles 14 include a series of holes spaced along the length of the poles 14 and which may be aligned with the hole in the sliding support mount 211. When the hole of the sliding support mount 211 is aligned with a hole in the pole 14, a screw or pin may be placed through both holes to thereby lock the sliding support mount 211 in position. The holes may be arranged such that the awning can be positioned at angles of 0 degree, 30 degrees, 60 degrees, 90 degrees, and 120 degrees, although any other angle or angle combination is possible.

While the adjustable side awnings are described in relation to the collapsible canopy also described herein, the adjustable side awnings are not limited to use with only the collapsible canopy described herein. The adjustable side awnings may also be adapted for use on other types of canopies.

Figure 5:
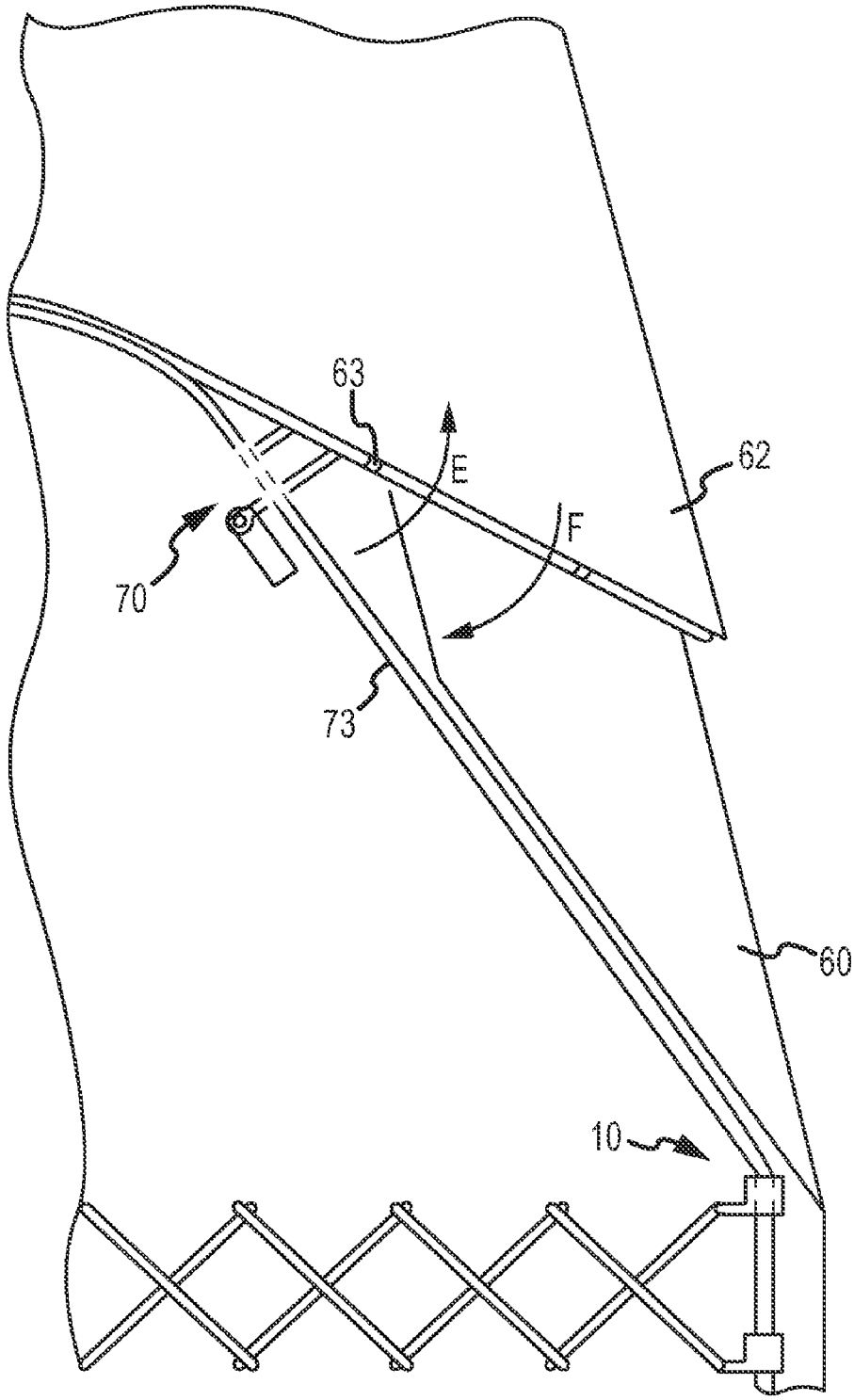
FIG. 5 shows a partial side plan view of one embodiment of the canopy frame and the canopy cover having at least one collapsible flap supported by a pivoting support.
Figure 9:
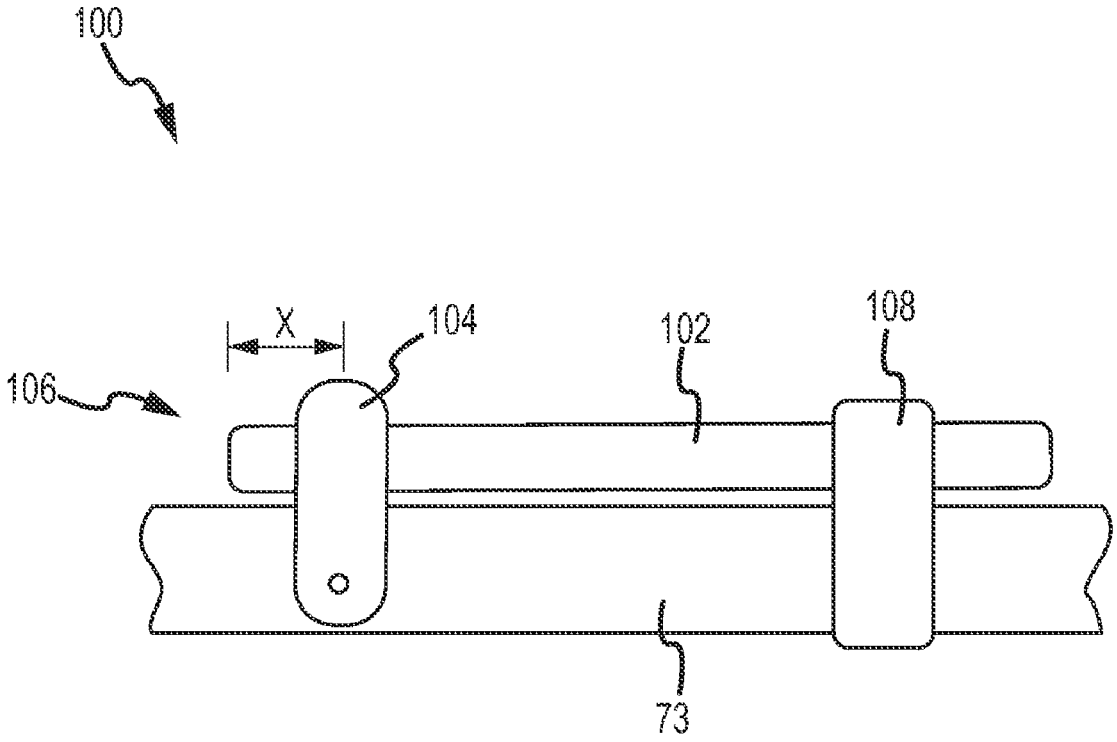
FIG. 9 shows a side plan view of the embodiment of the pivoting support shown in FIG. 8 in the closed position.
Figure 10:
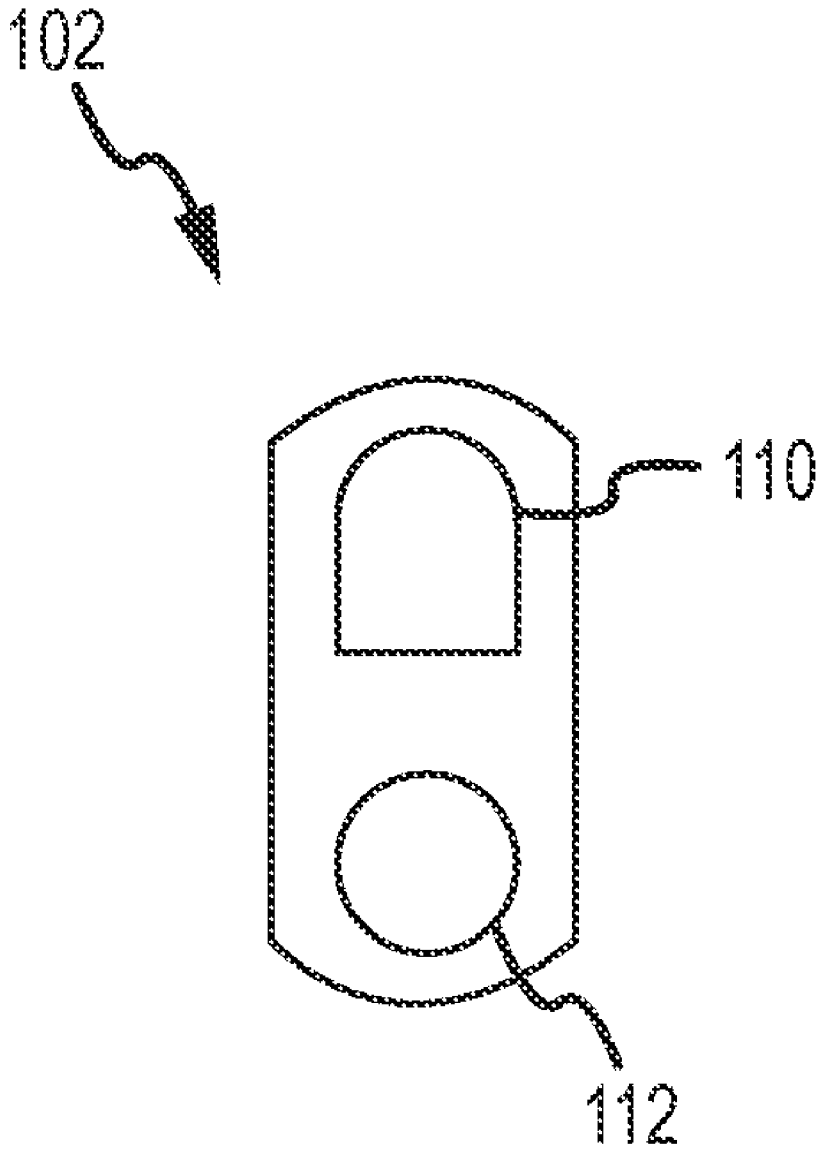
FIG. 10 shows a front plan view of one embodiment of a fulcrum.

To ventilate air from the collapsible canopy shelter, one embodiment of the collapsible canopy shelter may include at least one collapsible flap that may be opened and closed as desired. FIG. 5 shows a partial side plan view of one embodiment of canopy frame 10 having a cover support member 73, as well as a canopy cover 60 having at least one collapsible flap 62 supported by a pivoting support 70, 100 (FIGS. 9, 10). To ventilate air from beneath canopy cover 60, pivoting support 70, 100 may be used to pivot collapsible flap 62 in the direction of arrow E into an open position. Alternately, collapsible flap 62 may be pivoted in the direction of arrow F into a closed position to prevent air flow. One of ordinary skill in the art will readily understand that a user may also position collapsible flap 62 in any intermediate position between the open and closed positions.

Figure 6:
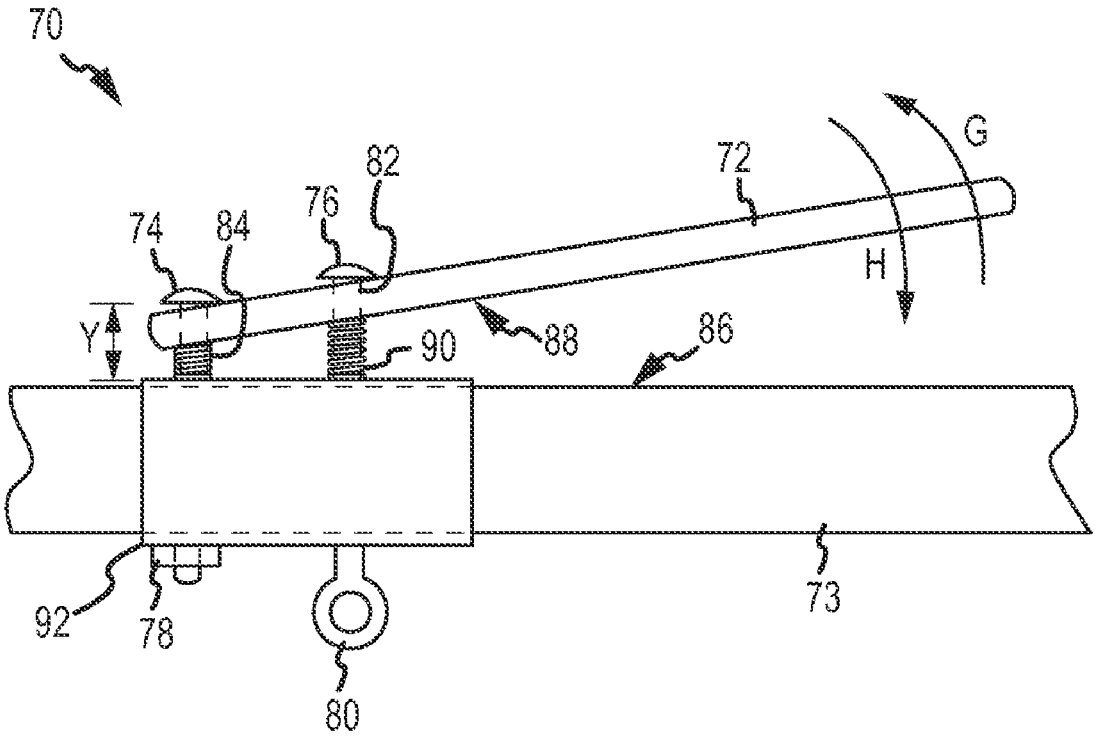
FIG. 6 shows a side plan view of one embodiment of the pivoting support in the open position.
Figure 7:
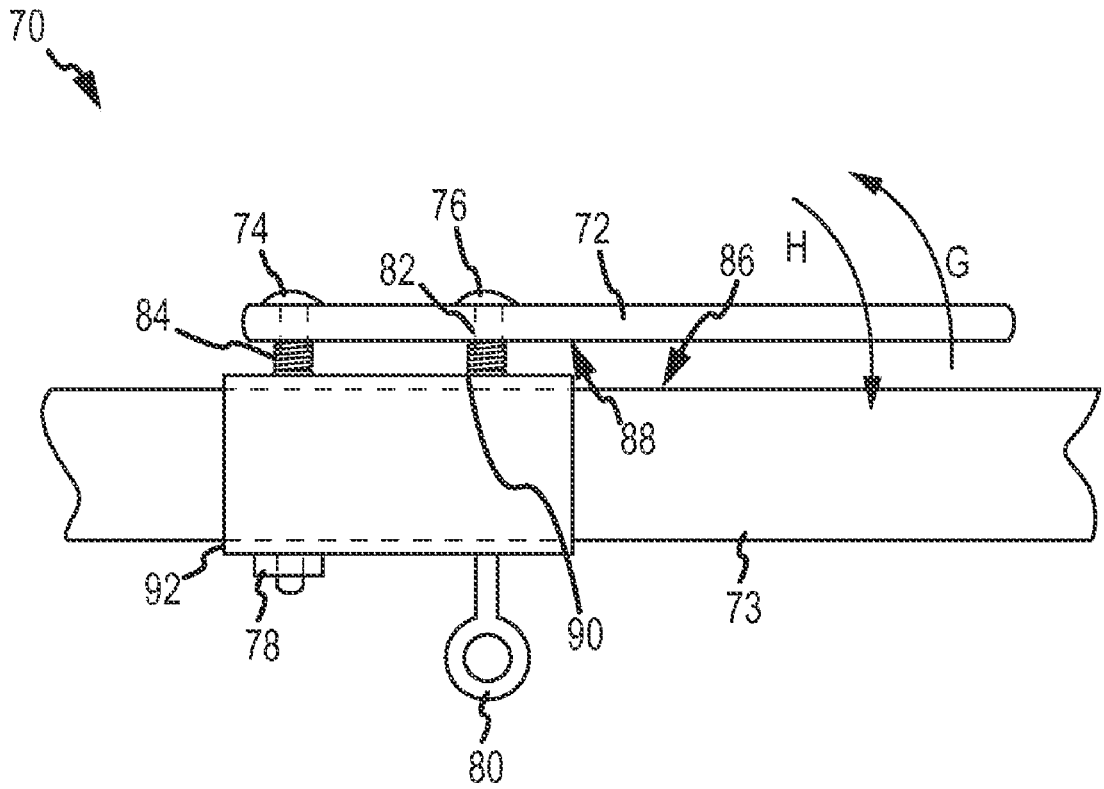
FIG. 7 shows a side plan view of the pivoting support shown in FIG. 6 in the closed position.

In further detail, FIGS. 6 and 7 show side plan views of one embodiment of pivoting support 70 in the open and a closed positions, respectively. In this embodiment, pivoting support 70 may comprise a cantilever 72 attached to collapsible flap 62 through a set of cover straps 63 or any other means of attachment generally known in the art, including, for example, a sheath formed of canopy material, snaps, VELCRO®, and the like. Cantilever 72 may also be pivotally coupled to cover support, member 73 through a fixed fastener 74 and an adjustable fastener 76, each of which may intersect cover support member 73 and cantilever 72 along, an axis that is perpendicular to cantilever 72. Fixed fastener 74 may beset at a fixed height y and held in position by a nut 78. Adjustable fastener 76 may comprise a handle 80 and be threaded into a threaded receiving hole 82 in cantilever 72, such that rotating handle 80 in a first direction pivots cantilever between the closed position and the open position in the direction of arrow G, and rotating adjustable fastener in a second, opposite direction pivots the cantilever between the open position and, the closed position in the direction of arrow H.

A first flexible spacer 84 may encase fixed fastener 74 between atop surface, 86 of cover support member 73 and a bottom surface 88 of cantilever 72, while a second flexible spacer 90 may encase adjustable fastener 76 between a top surface; 86 of cover support member 73 and a bottom surface 88 of cantilever 72. First and second flexible spacers 84, 90 stabilize cantilever 72 and allow it to pivot between the closed and open positions in response to the rotation of adjustable fastener 76. Flexible spacers may be formed of rubber or any other suitable elastic material with a density sufficient to withstand the downward force exerted by the weight of cantilever 72 and collapsible flap 62.

Fixed fastener 74 and adjustable fastener 76 may consist of a variety of rotational fasteners, including, for example, screws, bolts, adjustable pins, or any other suitable fastener as is generally known in the art. Optionally, pivoting support 70 may further comprise a sleeve 92. Sleeve 92 may provide aesthetic benefits as well as protect cover support member 73 from exposure to light and moisture at the points where it has been drilled to accommodate fixed fastener 74 and adjustable fastener 76.

Figure 8:
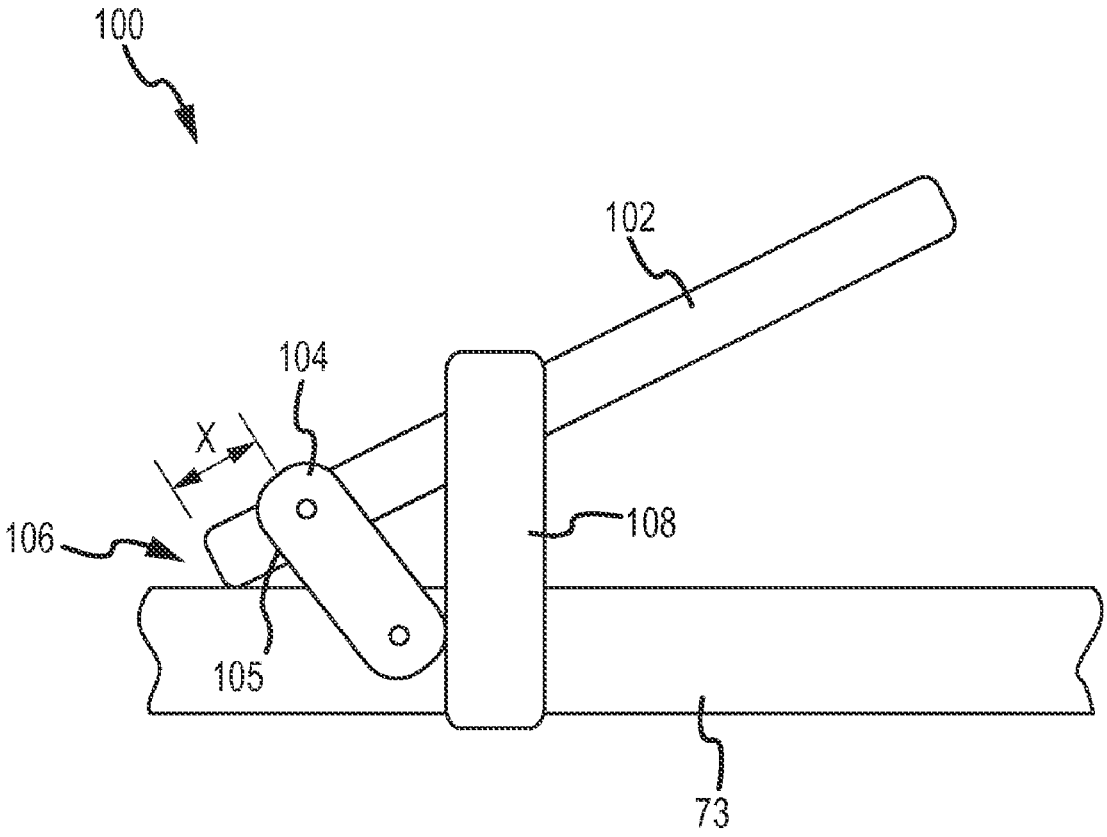
FIG. 8 shows a side plan view of another embodiment of a pivoting support in the open position.

FIGS. 8 and 9 illustrate side plan views of another embodiment of pivoting support 100 in the open and closed positions, respectively. Pivoting support 100 may comprise a cantilever 102 that is attached to cover support member 73 in the same manner discussed with respect to cantilever 72 above. Moreover, cantilever 102 may be pivotally coupled with cover support member 73 through a pivoting bracket 104 located at a pivot point 105. Pivoting bracket 104 may be offset a distance x from a pivot end 106 of cantilever 102, such that pivot end 106 serves as a hard stop to prevent cantilever 102 from rotating beyond the open position shown in FIG. 8. In addition, a fulcrum 108 may be slidably coupled to cover support member 73 such that it restrains cantilever 102 when in the closed position and props cantilever 102 when in the open position or any position between the closed and open positions.

FIG. 10 shows a front plan view of one embodiment of fulcrum 108. In this embodiment, fulcrum 108 may comprise a cantilever hole 110 sized to frictionally engage cantilever 102 when cantilever 102 is in the closed position shown in FIG. 9. Fulcrum 108 may further comprise a roof support hole; 112 configured to slidably engage with roof support member 73, such that it props cantilever 102 when in the open position shown in FIG. 8. Of course, one of ordinary skill in the art will readily understand that fulcrum 108 may prop cantilever 102 in any intermediate position between the closed and open positions to provide varying levels of air flow. Cantilever 102, bracket 104, and fulcrum 108 may be formed of metal, plastic, or any other material of suitable strength as is generally known in the art.

The previous description of the disclosed embodiments is provided to enable any person skilled in the art to make or use the present invention. Various modifications to these embodiments will be readily apparent to those skilled in the art, and the generic principles defined herein may be applied to other, embodiments without departing from the spirit or scope of the invention. Thus, the present invention is not intended to be limited to the embodiments shown herein but is to be accorded the widest scope consistent with the principles and novel features disclosed herein.

What is claimed is:

1. A collapsible canopy shelter, comprising:

a canopy cover; and a canopy frame to support the canopy cover, the canopy frame comprising a plurality of upwardly extending poles with an eave linking each pair of the plurality of upwardly extending poles, the eave comprising:

a plurality of pivotally coupled scissor-jacks, each scissor-jack having a left cross member and a right cross member crossed and pivotally coupled at a cross point, wherein a first left cross member is slidably coupled to a first pole, a first right cross member is fixably coupled to the first pole, a final left cross member is fixably coupled to a second pole, and a final right cross member is slidably coupled to the second pole; and two reinforcing cross members crossed and pivotally coupled at a cross point of the reinforcing cross members, the two reinforcing cross members also are pivotally coupled to the left and right cross members; and at least one adjustable side awning comprising:

a first awning arm having a first end, a second end, and a point between the first end and the second end, the first awning arm pivotably coupled at the first end to one of the plurality of corner support members;

a second awning arm having a first end, a second end, and a point between the first end and the second end, the second awning arm pivotably coupled at the first end to one of the plurality of corner support members adjacent the one of the plurality of corner support members to which the first awning arm is pivotably coupled;

an awning arm connecting portion having a first end and a second end, the awning arm connecting portion coupled at the first end to the second end of the first awning arm and coupled at the second end to the second end of the second awning arm;

an intermediate support bar extending between the first and second awning arms and coupled to the first and second awning arms at approximately a mid point along the length of the first and second awning arms;

the first and second awning arms being adjustable between a first length approximately equal to a length of the corner support members and a second length approximately half the length of the plurality of corner support members;

a first sliding support mount slidably coupled to the one of the plurality of corner support members to which the first awning arm is pivotably coupled;

a second sliding support mount slidably coupled to the one of the plurality of corner support members to which the second awning arm is pivotably coupled;

a first awning arm support having a first end and a second end, the first end pivotably coupled to the first awning arm at the point between the first end and the second end, and the second end pivotably coupled to the first sliding support mount;

a second awning arm support having a first end and a second end, the first end pivotably coupled to the second awning arm at the point between the first end and the second end, and the second end pivotably coupled to the second sliding support mount; and a side awning cover, the side awning cover extending between the first awning arm, the second awning arm and the awning arm connecting portion, wherein the side awning cover is adjustable between a position selected from the group of positions consisting of: a full awning position, a less than full awning position, a full sidewall position, or a less than full sidewall position.

2. The collapsible canopy shelter of claim 1, wherein the first and second sliding support mounts each comprise a locking mechanism for locking the first and second sliding support mounts in position on the corner support members to which they are coupled.

3. The collapsible canopy shelter of claim 2, wherein the locking mechanism comprises a hole in each of the first and second sliding support mounts and a series of holes running along the height of the corner support members to which the first and second sliding support mounts are attached, wherein the hole in each of the sliding support mounts may be aligned with any of the holes in the corner support members and a pin is placed through the hole in the sliding support mount and one of the holes in the corner support member to thereby lock the sliding support mount into place.

4. The collapsible canopy shelter of claim 1, wherein the first end of the first awning arm and the first end of the second awning arm are coupled to the corner support members proximate the top end of the corner support member.

5. The collapsible canopy shelter of claim 1, wherein the awning arm connecting portion is detachably coupled to the first awning arm and second awning arm.

6. The collapsible canopy shelter of claim 1, wherein the awning arm connecting portion is expandable and retractable.

7. The collapsible canopy shelter of claim 1, wherein the awning arm connecting portion is coupled to the first awning arm and second awning arm at right angles.

8. The collapsible canopy shelter of claim 1, wherein each of the upwardly extending poles comprises a fixed eave mount and a sliding eave mount coupled to at least one eave, the sliding eave mount comprises a latch having a spring loaded lever with a locking pin, the locking pin being configured to mate with a pin hole located at an assembled position in the upwardly extending pole, wherein the latch may be unlocked by pulling the spring loaded lever to disengage the locking pin from the pin hole, and wherein the latch may be locked by sliding the sliding eave mount into the assembled position such that the locking pin engages the pin hole.

9. The collapsible canopy shelter of claim 8, wherein the first sliding support mount is the same as the sliding eave mount and wherein the second sliding support mount is the same as the sliding eave mount.

10. The collapsible canopy shelter of claim 1, wherein the intermediate support bar is collapsible.

* * * * *